US011830651B2

(12) United States Patent
Ohnimus et al.

(10) Patent No.: US 11,830,651 B2
(45) Date of Patent: Nov. 28, 2023

(54) MAGNETIC CORE, METHOD FOR MANUFACTURING A MAGNETIC CORE AND BALUN WITH A MAGNETIC CORE

(71) Applicant: Rohde & Schwarz GmbH & Co. KG, Munich (DE)

(72) Inventors: Florian Ohnimus, Berlin (DE); Karl-Martin Müssener, Berlin (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 1064 days.

(21) Appl. No.: 16/430,804

(22) Filed: Jun. 4, 2019

(65) Prior Publication Data

US 2020/0051732 A1 Feb. 13, 2020

(30) Foreign Application Priority Data

Aug. 8, 2018 (EP) ..... 18187971

(51) Int. Cl.
*H01F 27/26* (2006.01)
*H01F 3/10* (2006.01)
(Continued)

(52) U.S. Cl.
CPC ..... *H01F 27/263* (2013.01); *H01F 3/10* (2013.01); *H01F 27/10* (2013.01); *H01F 27/22* (2013.01); *H01F 41/0206* (2013.01); *H01P 5/10* (2013.01)

(58) Field of Classification Search
CPC ..... H01F 27/263; H01F 3/10; H01F 27/10; H01F 27/22; H01F 41/0206;
(Continued)

(56) References Cited

U.S. PATENT DOCUMENTS 4,520,335 A * 5/1985 Rauch ..... H01F 27/245 336/212
5,977,842 A 11/1999 Brown et al.
(Continued)

FOREIGN PATENT DOCUMENTS

CN 202268479 U 6/2012
CN 105207623 A 12/2015
(Continued)

OTHER PUBLICATIONS

Extended European search report for European Patent Application No. 18187971.9, dated Nov. 26, 2018, 5 pages.
(Continued)

*Primary Examiner* — Shawki S Ismail
*Assistant Examiner* — Kazi S Hossain
(74) *Attorney, Agent, or Firm* — Westman, Champlin & Koehler, P.A.

(57) ABSTRACT

Magnetic core for a balun, balun with a magnetic core and method for manufacturing a magnetic core. In particular, a magnetic core is provided comprising multiple core elements, wherein the individual core elements are concentrically arranged. Furthermore, a heat sink is arranged between two adjacent core elements. By using multiple core elements for a magnetic core, the individual core elements can be adapted to different frequency ranges. In this way, the magnetic core may be used for a balun having a broad frequency range. Furthermore, thermal energy generated in the magnetic core can be dissipated by the heat sinks between the individual core elements. In this way, the power handling capability of the magnetic core can be increased.

12 Claims, 3 Drawing Sheets

(51) Int. Cl.

| | |
|---|---|
| ***H01F 27/10*** | (2006.01) |
| ***H01F 27/22*** | (2006.01) |
| ***H01F 41/02*** | (2006.01) |
| ***H01P 5/10*** | (2006.01) |

(58) Field of Classification Search
CPC .. H01F 2003/106; H01F 17/062; H01F 27/24; H01F 27/085; H01F 41/00; H01P 5/10
USPC ..... 336/212, 55–62
See application file for complete search history.

(56) References Cited

U.S. PATENT DOCUMENTS

| | | | | |
|---|---|---|---|---|
| 5,982,252 | A | 11/1999 | Werlau | |
| 7,215,220 | B1 | 5/2007 | Jia | |
| 7,215,292 | B2 | 5/2007 | McLean | |
| 7,508,289 | B1 * | 3/2009 | Wernicki | H01F 27/22 336/55 |
| 2006/0012535 | A1 | 1/2006 | McLean | |
| 2007/0075802 | A1 | 4/2007 | Gruchalla | |
| 2007/0126546 | A1 * | 6/2007 | Guenther | C22C 38/02 336/229 |
| 2007/0295715 | A1 | 12/2007 | Saka et al. | |
| 2012/0139682 | A1 | 6/2012 | Carlen et al. | |
| 2014/0132380 | A1 * | 5/2014 | Jacobson | H01F 27/24 29/605 |
| 2014/0266209 | A1 | 9/2014 | Apostolos et al. | |
| 2016/0078993 | A1 * | 3/2016 | Cedell | H01F 27/255 336/61 |
| 2016/0148748 | A1 * | 5/2016 | Shen | H01F 27/28 29/605 |
| 2019/0333676 | A1 * | 10/2019 | Shin | H01F 37/00 |

FOREIGN PATENT DOCUMENTS

| | | | | |
|---|---|---|---|---|
| EP | 1617515 | A1 | 1/2006 | |
| EP | 3 024 002 | A1 | 5/2016 | |
| JP | S52-344 | B1 | 1/1977 | |
| JP | H08505011 | A | 5/1996 | |
| JP | 2008-021948 | A | 1/2008 | |
| JP | 2008228257 | A | 9/2008 | |
| JP | 5121244 | B2 | 1/2013 | |
| KR | 20150072211 | A | 6/2015 | |
| RU | 2 656 861 | C1 | 6/2018 | |
| RU | 2656861 | C1 * | 6/2018 | H01F 17/06 |

OTHER PUBLICATIONS

Notification of Reasons for Rejection, including Search Report, for Japanese Patent Application No. 2019-115263, dated Mar. 10, 2023, 13 pages.
Communication pursuant to Article 94(3) EPC, for European Patent Application No. 18187971.9, dated Mar. 10, 2022, 7 pages.

* cited by examiner

MAGNETIC CORE, METHOD FOR MANUFACTURING A MAGNETIC CORE AND BALUN WITH A MAGNETIC CORE

CROSS-REFERENCE TO RELATED APPLICATION(S)

This application claims priority to European Patent Application No. 18187971.9, filed on Aug. 8, 2018, the content of which is hereby incorporated herein by reference in its entirety.

TECHNICAL FIELD

The present invention relates to a magnetic core for a balun, a symmetrical balun with a magnetic core, and a method for manufacturing a magnetic core for a balun.

TECHNICAL BACKGROUND

A balun is a device which is used as transition between an unbalanced line and a balanced line. An unbalanced two-wireline may be a line wherein one of the two conductors is grounded, for example a coaxial cable with the outer shield grounded. A balanced two-wireline may be a line in which none of the two conductors is grounded and wherein both wires have almost identical impedances to ground. Accordingly, a balun may be a transformer which allows isolation of the unbalanced line from the balanced line. The use of such a transformer also allows impedance matching from the unbalanced line to the balanced line.

An essential component of a balun may be a magnetic core of the balun. The properties of a magnetic core in a balun may be adapted depending on the desired application. For example, the magnetic core has to be adapted depending on a desired frequency range and the power of a signal which shall be converted by the balun.

SUMMARY

Against this background, there is the need to provide an improved magnetic core for a balun which can be used in a broad frequency range.

Further, the present invention aims to provide a magnetic core for a balun with high power dissipation, for example with power dissipation due to magnetic losses.

The present invention provides a magnetic core, a balun and a method for manufacturing a magnetic core having the features of the independent claims.

Further advantageous embodiments are subject matter of the dependent claims.

According to a first aspect, a magnetic core for a balun is provided. The magnetic core comprises a number of at least two core elements and at least one heat sink. The number of core elements and the at least one heat sink are arranged in a concentric manner. In particular, the at least one heat sink is arranged between the number of core elements. In case there are more than two core elements, a separate heat sink may be arranged between two core elements, respectively.

According to a second aspect, a balun is provided. The balun comprises at least one magnetic core according to the first aspect of the present invention. In particular, the balun may be a symmetrical balun.

According to a third aspect, a method for manufacturing a magnetic core for a balun is provided. The method comprises a step of providing a number of at least two core elements; and a step of providing at least one heat sink. The method further comprises a step of arranging the number of core elements and the at least one heat sink concentrically. In particular, the at least one heat sink is arranged between the number of core elements. In case there are more than two core elements, a separate heat sink may be arranged between two core elements, respectively.

The present invention is based on the fact that a magnetic core is an essential element of a balun. The properties of a balun such as frequency range, thermal load-bearing capacity and consequently power handling capability are limited by the properties of the magnetic core of a balun.

The present invention therefore takes into account this finding and aims to provide an improved magnetic core. In particular, the present invention aims to provide a magnetic core for a balun which can be used over a wide frequency range, and therefore achieving a higher bandwidth of the balun. Furthermore, the present invention aims to provide a magnetic core for a balun with a higher power handling capability.

For this purpose, the present invention provides a magnetic core comprising multiple core elements which are arranged in a concentric manner. Accordingly, the multiple magnetic cores are arranged such that all magnetic cores comprise a common axis of symmetry. Furthermore, the individual core elements are separated by one or more heat sinks. In particular, a heat sink is arranged between two adjacent core elements.

By using more than one core element, each core element of the number of at least two core elements may be adapted to predetermined properties, for example to a predetermined frequency range. By using more than one core element, each core element may be optimized for another frequency range. Thus, the frequency range of the magnetic core comprising multiple core elements may be expanded based on a combination of the individual frequency range of each core element. For example, the frequency range of a core element may be adapted based on the material or material composition used for a core element, a thickness and/or length of a core element or another parameter characterizing the respective core element. Accordingly, the frequency range, i.e. the bandwidth of a balun comprising such a magnetic core may be expanded based on a combination of the frequency ranges of the individual core elements.

By arranging heat sinks between the individual core elements, thermal energy generated by the core elements may be dissipated. For example, the energy of the magnetic losses in the core elements may be dissipated by the heat sink arranged in a thermal connection to a magnetic core. In this way, the thermal energy may be dissipated from the magnetic core elements by the heat sink and thus, the power handling capability of the magnetic core can be increased. For example, parasitic resonances may be eliminated by damping the resonances, and the thermal energy caused due to the damping of the resonances may be dissipated by the respective heat sinks.

Furthermore, by arranging a heat sink between two core elements, the individual core elements may be arranged spaced apart from each other, and the arrangement of the multiple core elements can be mechanically stabilized by the heat sinks between the core elements. In this way, a solid arrangement comprising multiple core elements can be achieved.

Further embodiments of the present invention are subject of the further subclaims and of the following description, referring to the drawings.

In a possible embodiment, the magnetic core comprises at least two core elements and at least two heat sinks.

Furthermore, it may be possible that the magnetic core may comprise even more than three core elements. In particular, a separate heat sink may be arranged between two adjacent core elements. Hence, the number of heat sinks may be one smaller than the number of core elements. By using multiple core elements, the characteristics of the magnetic core and therefore of a balun with such a magnetic core can be adapted in a broad range, in particular a broad frequency range.

In a possible embodiment, each core element of the number of core elements comprises a ferrite.

A ferrite is a ceramic material comprising iron(III)oxide and small portions of one or more additional metallic elements. In particular, the magnetic core may comprise a soft ferrite. Soft ferrites have a low coercivity so they easily change their magnetization. However, any other appropriate material, in particular any appropriate soft magnetic material may be also used for the core elements of the magnet core.

In a possible embodiment, each core element of the number of core elements comprises a same material.

For example, all core elements of the magnetic core may be manufactured by a same soft magnetic material. By using the same material for all core elements, the physical properties of the individual core elements are the same and thus, thermal strength or the like may be avoided.

In an alternative embodiment, the materials of each core element of the number of core elements are different.

By using different materials for the individual core elements, the properties, for example the frequency range or the bandwidth of the individual core elements can be easily adapted. For example, different soft magnetic materials may be used for manufacturing the individual core elements. For example, a different type of ferrite may be used for each core element of the number of core elements. In particular, a first ferrite may be used in an inner core which is adapted for a higher frequency range, and another ferrite may be used in an outer core which is related to a lower frequency range.

In a possible embodiment, the at least one heat sink comprises a metallic or ceramic material.

Furthermore, any kind of material having an appropriate thermal conductivity may be used for the at least one heat sink. If more than one heat sink is applied in the magnetic core, the individual heat sinks may comprise a same material. Alternatively, it may be also possible to use different materials for the individual heat sinks.

By using an electrically conductive material for the heat sinks, the heat sink may also provide a shielding against stray fields. In this way, the high frequency performance may be further improved.

However, any other appropriate material may be also used. For example polytetrafluorethylene (PTFE, "Teflon") or another polymer may be used for a heat sink.

In a possible embodiment, each core element of the number of core elements is adapted to achieve a predetermined bandwidth of the balun.

Higher frequencies may magnetize only the innermost core, or only some of the inner cores. In contrast to this, lower frequencies may also magnetize the outer core elements. By adapting the properties of the individual core elements, for example by selecting different materials, a different size for the individual core elements or the like, the properties of the magnetic core in particular with respect to the individual frequencies may be adapted accordingly.

In a possible embodiment, the number of core elements may have a cylindrical shape. Additionally, or alternatively, the at least one heat sink has a cylindrical shape. In particular, the core elements and/or the at least one heat sink may have a hollow cylindrical shape.

By using hollow cylinders for the core elements and the heat sinks, the assembly of the magnetic core based on the multiple core elements and the heat sink can be simplified. For example, the individual components may be pressed together. However, any other type of assembling the magnetic core may be also possible. Furthermore, it may be also possible to use core elements and heat sinks having another appropriate shape, for example an elliptical shape, a rectangular shape or squared cross section, etc.

In a possible embodiment, each of the at least one heat sinks is arranged in thermal connection with two adjacent core elements. The thermal connection between the heat sink and the core elements may be achieved, for example by arranging the heat sink close to the related core elements without any significant space. Furthermore, a thermal compound or a thermal conductive glue may be used for a thermal connection between the heat sink and the core elements.

In a possible embodiment, the magnetic core may further comprise a cooler. The cooler may be thermally coupled with the at least one heat sink. The cooler may be adapted to dissipate thermal energy from the at least one heat sink.

By applying an additional cooler for dissipating the thermal energy, the thermal energy generated in the magnetic core may be efficiently dissipated. The cooler may be any kind of appropriate cooler. In particular, the cooler may be an active cooler or a passive cooler having a large surface for dissipating the thermal energy.

In a possible embodiment, the cooler may comprise a liquid cooling device.

The liquid cooling device may comprise a liquid or a fluid for transferring the thermal energy from the heat sink to another spatial location for dissipating the thermal energy. For example, the liquid may comprise water or any other kind of fluid.

In a possible embodiment, the cooler may comprise an air cooling device.

For example, the cooler may comprise a device for dissipating the thermal energy by means of forced air. For this purpose, a fan or the like may be used.

In a possible embodiment of the balun, the balun may comprise a symmetrical balun.

For example, the balun may be a 1:1 balun. In particular, an impedance of the unbalanced transmission line may correspond to an impedance of the symmetrical transmission line. The balun may provide a 1:1 current transformation. The balun may also provide a 1:1 voltage transformation.

However, it may also possible to apply the magnetic core in any other kind of balun. For example, the balun may be part of a balun providing a 1:4 transformation of any other transformation ratio.

The balun may be used in any kind of radio frequency device. For example, the balun may be used in an amplifier, a measurement device, for coupling an antenna, etc.

With the present invention it is therefore now possible to realize a balun for a transition between an unbalanced line and a balanced line, wherein the balun may have a broad bandwidth and a high power handling capability. For this purpose, the magnetic core is realized by multiple core elements in a concentric configuration. Between the individual core elements, additional heat sinks are arranged for dissipating the thermal energy generated in the core elements. In this way, a very compact balun assembly can be achieved providing an optimal use of volumetric space.

BRIEF DESCRIPTION OF THE DRAWINGS

For a more complete understanding of the present invention and advantages thereof, reference is now made to the following description taken in conjunction with the accompanying drawings. The invention is explained in more detail below using exemplary embodiments which are specified in the schematic figures of the drawings, in which.

Figure 1:
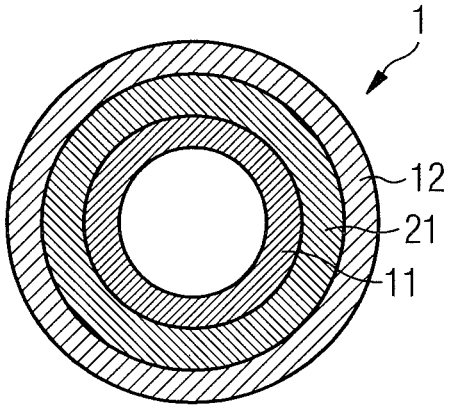
FIG. 1 shows a cross-section of a magnetic core according to an embodiment of the present invention.

The appended drawings are intended to provide further understanding of the embodiments of the invention. They illustrate embodiments and, in conjunction with the description, help to explain principles and concepts of the invention. Other embodiments and many of the advantages mentioned become apparent in view of the drawings. The elements in the drawings are not necessarily shown to scale.

In the drawings, like, functionally equivalent and identically operating elements, features and components are provided with like reference signs in each case, unless stated otherwise.

DETAILED DESCRIPTION

FIG. 1 shows a cross-section of a magnetic core 1 according to an embodiment. The magnetic core 1 may be used, for example for a balun. As can be seen in FIG. 1, the magnetic core 1 may comprise a number of at least two core elements 11, 12. Furthermore, the magnetic core 1 comprises at least one heat sink 21. The heat sink 21 is arranged between the two core elements 11, 12. The core elements 11, 12 may be manufactured as hollow cylinders. Accordingly, the heat sink 21 may be also have a shape of a hollow cylinder. In particular, the dimensions of the two core elements 11, 12 and the heat sink 21 may be such that the individual elements fit right into each other. In other words, the outer diameter of the inner core element 11 almost corresponds to the inner diameter of the heat sink 21. Accordingly, the inner diameter of the outer core element 12 almost corresponds to the outer diameter of the heat sink 21. In this way, a thermal connection between the heat sink 21 and the core elements 11, 12 can be achieved.

For example, the core elements 11, 12 and the heat sink 21 may be pressed together. However, it may be also possible that a thermal conductive glue may be used to combine the core elements 11, 12 and the heat sink 21. Furthermore, a thermal compound may be used for thermally coupling the heat sink 21 and the core elements 11, 12.

As can be further seen in FIG. 1 the innermost core element 11 may be a hollow cylinder, i.e. the innermost core element 11 may have an inner opening. In this way, one or more conductors may be put through this opening when building a balun.

Figure 2:
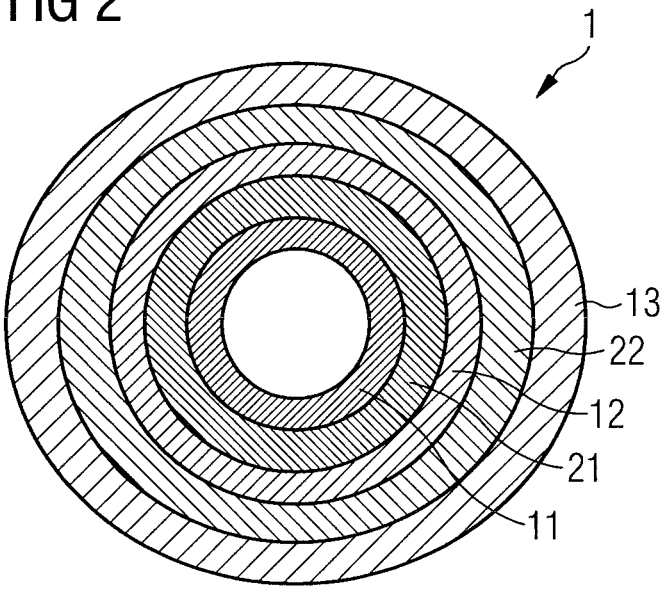
FIG. 2 shows a cross-section of a magnetic core according to another embodiment of the present invention.

FIG. 2 shows a further embodiment of a magnetic core 1. The magnetic core 1 according to FIG. 2 mainly corresponds to the previously described magnetic core 1. Thus, explanation in connection with FIG. 1 also applies to the magnetic core 1 of FIG. 2, and vice versa, the explanation in connection with FIG. 2 may be also applied to the magnetic core of FIG. 1.

The magnetic core 1 in FIG. 2 differs from the previously described magnetic core 1 in that the magnetic core 1 according to FIG. 2 comprises a further core element 13 and a further heat sink 22. However, it is understood that the present invention is not limited to only two or three magnetic core elements 11, 12, 13 and one or two heat sinks 21, 22. Furthermore, any appropriate number of core elements 11, 12, 13 and any appropriate number of heat sinks 21, 22 may be used. In particular, the number of core elements 11, 12, 13 may be one greater than the number of heat sinks 21, 22.

The individual core elements 11, 12, 13 may be all manufactured by a same material. In particular, an appropriate ferrite, such as a soft magnetic ferrite may be used for the core elements 11, 12, 13. However, it is understood that any other appropriate material for a magnetic core may be also used. By adapting the size of the individual core elements 11, 12, 13, the characteristic properties of the individual core elements may be adapted. For example, if a signal is transmitted through the inner opening of the magnetic core 1, the higher frequencies will only magnetize the innermost core element 11. Hence, the dimensions of the innermost core element 11 may be adapted based on the desired properties for the higher frequency components. Furthermore, lower frequency components of a signal which is guided through the inner opening of the magnetic core 1 will magnetize not only the innermost core element 11, but also further core elements 12 and 13. Thus, the dimensions of the further core elements 12, 13 may be adapted depending on the respective frequencies which magnetize the corresponding core elements 12, 13. Hence, a length and/or a thickness of the individual core elements 11, 12, 13 may be adapted depending on the respective frequencies.

Alternatively, it may be also possible to use different materials for the core elements 11, 12, 13. For example, a different material may be used for each of the core elements 11, 12, 13. For example, customized materials for magnetic cores are available from Ferroxcube. However, any other appropriate material for a magnetic core, in particular customized materials for magnetic cores may be also used. As already explained above, higher frequencies will only magnetize inner magnetic cores 11, and lower frequencies may also magnetize outer magnetic cores 13. Thus, by selecting appropriate materials for each of the magnetic core elements 11, 12, 13, the frequency characteristics of the magnetic core 1 may be adapted accordingly. For example, Ferroxcube 4C5 may be used for an inner core which is magnetized by higher frequencies, and Ferroxcube N30 may be used for an outer core element 12 or 13 which is also magnetized by lower frequencies.

The heat sinks 21, 22 may comprise any appropriate material for conducting the thermal energy which is generated in the magnetic core 1. For example, the heat sinks 21, 22 may comprise a metal and/or a ceramic. However, any other appropriate material, for example a polymer such as polytetrafluoroethylene (PTFE, Teflon) may be also used as a heat sink. The heat sinks 21, 22 may dissipate the thermal energy generated in the core elements 11, 12, 13. For example, parasitic resonances may be eliminated and the energy of these parasitic resonances may be converted to thermal energy which is dissipated by the heat sinks 21, 22.

In case the heat sinks 21, 22 may comprise electrically conductive material, e.g. a metal, the heat sinks 21, 22 may also provide a shield against stray fields. In this way, the shielding may provide a further improvement with respect to the high frequency performance.

Figure 3:
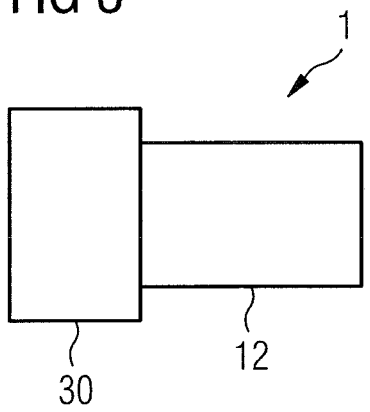
FIG. 3 shows schematic view of a magnetic core according to an embodiment of the present invention.

FIG. 3 shows a schematic drawing of a magnetic core 1 according to a further embodiment. Further to the core elements 11, 12, 13 and the heat sinks 21, 22 as described above, the core element 1 in this embodiment comprises an additional cooler 30. The cooler 30 may be thermally coupled with the heat sinks 21, 22. Accordingly, cooler 30 may dissipate the thermal energy which is conducted from the core elements 11, 12, 13 to the cooler 30. Cooler 30 may be a passive cooler comprising cooling elements for emitting the thermal energy. Alternatively, cooler 30 may be an active cooler. For example, cooler 30 may comprise a fan for providing a forced air cooling. In another embodiment, cooler 30 may be a cooler comprising a fluid cooling system. For example, water or another fluid may be used for dissipating the thermal energy from the heat sink to the environment. For this purpose, a pump (not shown) may be used for pumping around the fluid. However, it is understood that any other kind of cooler 30 may be also applied for dissipating the thermal energy.

Figure 4:
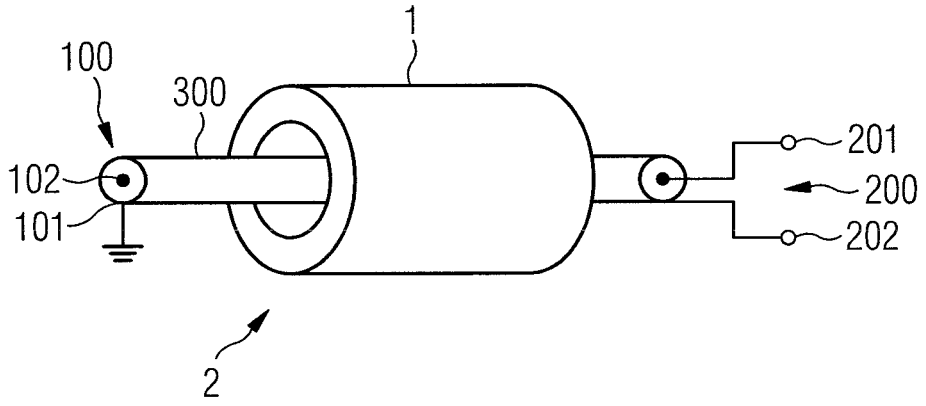
FIG. 4 shows a circuit diagram of a balun according to an embodiment of the present invention.

FIG. 4 shows a schematic circuit diagram of a balun 2 according to an embodiment. As can be seen in FIG. 4, the balun 2 comprises an unbalanced port 100. A first terminal 101 of the unbalanced port may be grounded. Another terminal 102 of the unbalanced port 100 may be connected with a signal line. For example, the unbalanced port may be connected with a coaxial cable 300. However, any other cable may be also used. The cable 300 may be arranged in the inner part of the magnetic core 1. The other end of the cable 300 may be connected with a balanced port 200. The balanced port 200 may comprise a first terminal 201 and a second terminal 202. For example, the first terminal 201 may be connected with an inner conductor of the coaxial cable 300 and the second terminal 202 may be connected with the shielding of the coaxial cable 300.

Figure 5:
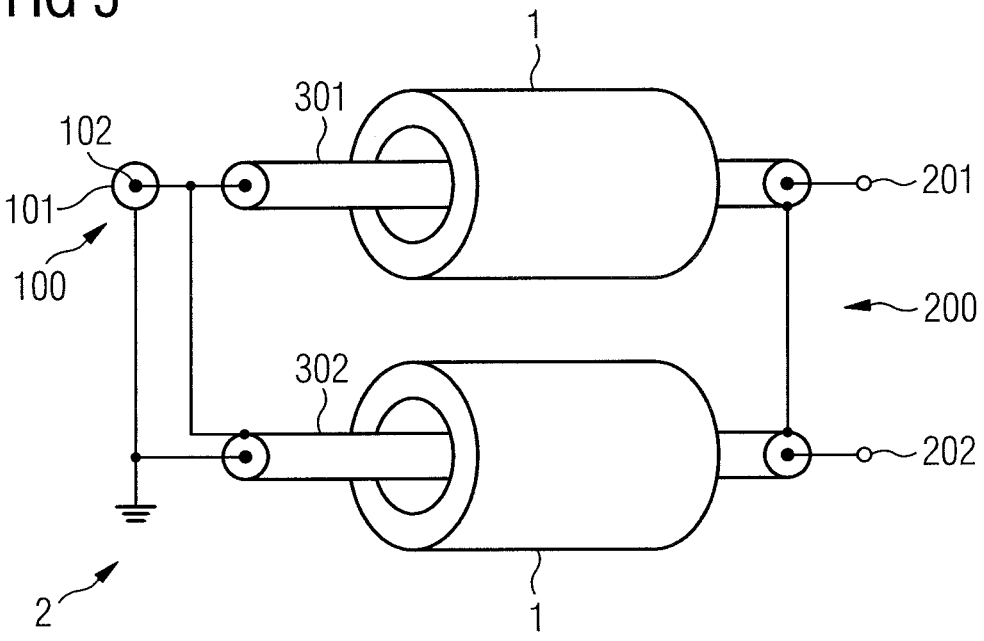
FIG. 5 shows a circuit diagram of a balun according to a further embodiment of the present invention.

FIG. 5 shows a further embodiment of a balun 2. The balun 2 according to FIG. 5 comprises two cables 301, 302. A first terminal 101 of the unbalanced port 100 may be connected with an inner connector of the second coaxial cable 302. A second terminal 102 of the unbalanced port 100 may be connected with an inner connector of the first coaxial cable 301 and the shielding of the second coaxial cable 302. Furthermore, the shielding of the first coaxial cable 301 and the second coaxial cable 302 may be connected with each other at the position of the balanced port 200. Furthermore, the inner connector of the first coaxial cable 301 may be connected with a first terminal 201 of the balanced port 200, and the inner connector of the second coaxial cable 302 may be connected with the second terminal 202 of the balanced port 200. A magnetic core 1 may be arranged around each of the coaxial cables 301 and 302.

The above described embodiments of a balun according to FIG. 4 and FIG. 3 only show two exemplary embodiments. However, it is understood that the present invention is not limited to the above-mentioned baluns 2. Furthermore, the magnetic core 1 according to the present invention may be used for any other kind of balun for coupling an unbalanced line with a balanced line.

For the sake of clarity in the following description of the method based on FIG. 6, the reference signs above in the description of the magnetic core 1 and the balun 2 based on FIGS. 1 to 5 will be maintained.

Figure 6:
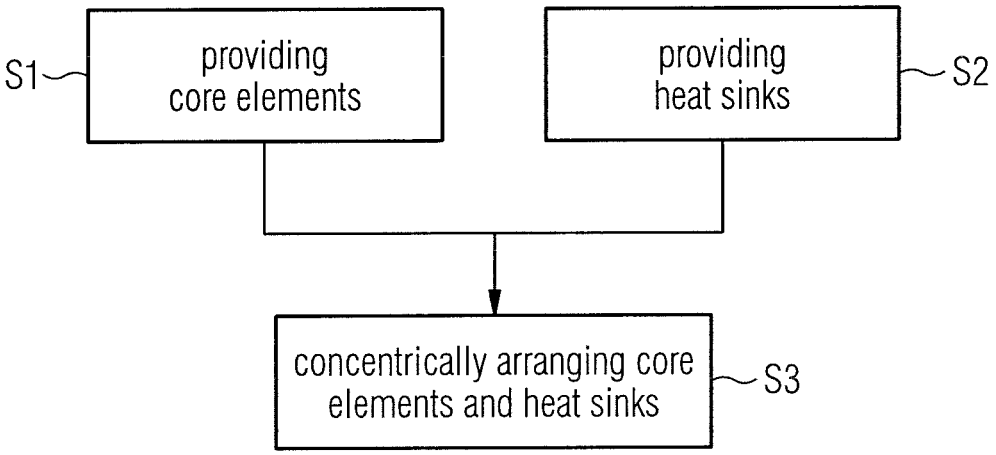
FIG. 6 shows a block diagram of an embodiment of a method according to the present invention.

FIG. 6 shows a block diagram of a method for manufacturing a magnetic core for a balun. The method comprises a step S1 of providing a number of at least two core elements 11, 12, 13, and a step S2 of providing at least one heat sink 21, 22. Further, the method comprises a step S3 of arranging the number of core elements 11, 12, 13 and the at least one heat sink 21, 22 concentrically. In particular, the at least one heat sink 21, 22 is arranged between the number of core elements 11, 12, 13.

The method may further comprise a step of thermally coupling a cooler 30 with the at least one heat sink 21, 22.

Summarizing, the present invention relates to a magnetic core for a balun and a balun with such a magnetic core. In particular, a magnetic core is provided comprising multiple core elements, wherein the individual core elements are concentrically arranged. Furthermore, a heat sink is arranged between two adjacent core elements. By using multiple core elements for a magnetic core, the individual core elements can be adapted to different frequency ranges. In this way, the magnetic core may be used for a balun having a broad frequency range. Furthermore, thermal energy generated in the magnetic core can be dissipated by the heat sinks between the individual core elements. In this way, the power handling capability of the magnetic core and the balun with such a magnetic core is enhanced.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections between various elements as shown and described with respect to the drawings may be a type of connection suitable to transfer signals from or to the respective nodes, units or devices, for example via intermediate devices. Accordingly, unless implied or stated otherwise the connections may for example be direct connections or indirect connections.

In the description, any reference signs shall not be construed as limiting the claim. The word "comprising" does not exclude the presence of other elements or steps then those listed in a claim. Furthermore, the terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage. The order of method steps as presented in a claim does not prejudice the order in which the steps may actually be carried out, unless specifically recited in the claim.

Skilled artisans will appreciate that the illustrations of chosen elements in the drawings are only used to help to improve the understanding of the functionality and the arrangements of these elements in various embodiments of the present invention. Also, common and well understood elements that are useful or necessary in a commercially feasible embodiment are generally not depicted in the drawings in order to facilitate the understanding of the technical concept of these various embodiments of the present invention. It will further be appreciated that certain procedural stages in the described methods may be described or depicted in a particular order of occurrence while those skilled in the art will understand that such specificity with respect to sequence is not actually required.

What is claimed is:

1. A magnetic core for a balun, the magnetic core comprising:

a number of at least three core elements;

at least two heat sinks; and a cooler thermally coupled with the at least two heat sinks, wherein the cooler is adapted to dissipate thermal energy from the at least two heat sinks, wherein the number of core elements and the at least two heat sinks are arranged concentrically, and wherein each of the at least two heat sinks is arranged between two adjacent core elements, and wherein the number of core elements and has a cylindrical shape or a hollow cylindrical shape, wherein each core element of the number of core elements is adapted to achieve a predetermined bandwidth of the balun, wherein a length or a thickness of the individual core elements is adapted to respective frequencies, which magnetize the corresponding core elements.

2. The magnetic core of claim 1, wherein each core element of the number of core elements comprises a ferrite.

3. The magnetic core of claim 1, wherein each core element of the number of core elements comprises a same material.

4. The magnetic core of claim 1, wherein the materials of each core element of the number of core elements are different.

5. The magnetic core of claim 1, wherein the at least one heat sink comprises a metallic material.

6. The magnetic core of claim 1, wherein the at least one heat sink comprises a ceramic material.

7. The magnetic core of claim 1, wherein the at least one heat sink has a cylindrical shape or a hollow cylindrical shape.

8. The magnetic core of claim 1, wherein each of the at least one heat sinks is arranged in thermal connection with two adjacent core elements.

9. The magnetic core of claim 1, wherein the cooler comprises a liquid cooling device.

10. The magnetic core of claim 1, wherein the cooler comprises an air cooling device.

11. A balun, the balun comprising:

a magnetic core comprising a number of at least three core elements, at least two heat sinks and a cooler thermally coupled with the at least two heat sinks, wherein the cooler is adapted to dissipate thermal energy from the at least two heat sinks, wherein the number of core elements and the at least two heat sinks are arranged concentrically, wherein each of the at least two heat sinks is arranged between two adjacent core elements, and wherein the number of core elements has a cylindrical shape or a hollow cylindrical shape or a hollow cylindrical shape, wherein each core element of the number of core elements is adapted to achieve a predetermined bandwidth of the balun, wherein a length or a thickness of the individual core elements is adapted to respective frequencies, which magnetize the corresponding core elements.

12. The balun of claim 11, wherein the balun is a symmetrical balun.

* * * * *